United States Patent [19]

Farquhar

[11] 4,054,203

[45] Oct. 18, 1977

[54] CARTON AND BLANK FOR MAKING SAME

[75] Inventor: Melville T. Farquhar, Richmond, Va.

[73] Assignee: Reynolds Metals Company, Richmond, Va.

[21] Appl. No.: 752,898

[22] Filed: Dec. 22, 1976

[51] Int. Cl.[2] ..... B65D 5/50

[52] U.S. Cl. ..... 206/45.14; 206/45.19; 206/491; 206/277; 229/39 R; 229/38

[58] Field of Search ..... 206/45.14, 45.19, 491, 206/277; 229/36, 38, 39 R, 39 B

[56] References Cited

U.S. PATENT DOCUMENTS

| | | | |
|---|---|---|---|
| 1,838,269 | 12/1931 | Langford et al. | 229/38 |
| 2,682,949 | 7/1954 | Whitehead | 229/38 |
| 2,971,688 | 2/1961 | Akers | 229/38 |
| 3,397,772 | 8/1968 | Farquhar | 206/45.14 |
| 3,669,253 | 6/1972 | Hanko | 206/45.14 |
| 3,724,741 | 4/1973 | Jacobson | 229/38 |

FOREIGN PATENT DOCUMENTS

| | | | |
|---|---|---|---|
| 97,331 | 6/1939 | Sweden | 229/39 B |
| 209,618 | 6/1924 | United Kingdom | 229/38 |

*Primary Examiner*—William Price
*Assistant Examiner*—Douglas B. Farrow
*Attorney, Agent, or Firm*—Glenn, Lyne, Gibbs & Clark

[57] ABSTRACT

A carton and blank for making same are provided wherein such carton is particularly adapted to contain a bottle having a lower main body and an upwardly extending elongated neck and the carton has a reinforcing flap in the upper portion thereof with such reinforcing flap having opposed supporting side edges disposed in spaced relation beneath a top panel of the carton enabling such flap to serve as a horizontal reinforcement against collapse of the carton sides upon squeezing such sides toward each other during grasping of the carton for lifting and carrying purposes. The reinforcing flap is also such that upon disposing an unshrunk sealing sleeve around the upper portion of the neck and a closure for the bottle such flap may be placed in its final position and the carton closed immediately without sliding or damaging the unshrunk sleeve.

25 Claims, 11 Drawing Figures

CARTON AND BLANK FOR MAKING SAME

BACKGROUND OF THE INVENTION

Various beverages, particularly alcoholic beverages, are often sold in bottles which are packaged, stored, and sold in decorative gift cartons. For example, half gallon liquor bottles are often packaged in such cartons and such liquor bottles usually have a comparatively large lower body which tapers to a centrally disposed vertically extending elongated neck which is provided with a closure in the form of a screw cap or a stopper. These cartons are usually placed on and removed from store shelves and carried by grasping each carton with a thumb extending down one side thereof and the fingers down the opposed side thereof and the compressive loads on the carton are usually such that each of the previously proposed cartons caves in near the top leaving not only a weakened gift carton but one that is unsightly.

It is also common practice in the liquor industry to dispose a plastic sleeve, or the like, around the lower portion of a bottle closure and the upper portion of the bottle neck and shrink such sleeve in position so that it must be cut or severed in order to remove the cap or stopper. The usual procedure is to fill the bottle with liquor, place the closure in position, dispose the closed bottle in a gift carton, and dispose the shrinkable sleeve around the neck and closure so that upon shrinking thereof the sleeve forms the above-mentioned seal between the closure and neck. However, it is important that such shrinkable sleeve not be moved or wrinkled until it has had an opportunity to shrink in position whereby the usual practice heretofore employing previously proposed cartons has been to delay closing the carton a sufficient time to allow the sleeve to shrink in position and thereby prevent the unshrunk sleeve from being damaged or pushed a substantial distance downwardly along the neck of the bottle toward the body of such bottle thus effectively moving the upper portion of the unshrunk sleeve so that it does not engage the closure once it shrinks in position thereby in effect frustrating the purpose of providing such a sleeve.

Accordingly, previously proposed cartons of the character mentioned are deficient in that they have sides which tend to collapse near their upper ends when grasped in the manner mentioned above for carrying purposes. In addition, such cartons are such that they require substantial time delays in order to allow unshrunk sleeves employed on associated bottles to shrink in position before closing of such cartons.

SUMMARY

This invention provides an improved carton and blank for making same wherein the carton is particularly adapted to contain therein a bottle having a centrally disposed upwardly extending stem-like elongated neck and the upper portion of the carton may be grasped and the carton carried by squeezing the carton sides in the upper portion thereof adjacent such neck yet without collapsing or damaging such sides.

This invention also provides a carton and blank for making same of the character mentioned wherein the carton while open at the top is particularly adapted to have a bottle placed therein which has a lower main body and an upwardly extending elongated neck provided with a closure which enables an unshrunk sleeve to be disposed around the lower portion of the closure and around the upper portion of the neck and wherein the carton may be processed in an uninterrupted manner while placing components thereof in position which prevent collapse of the carton sides of the character mentioned yet without stopping to allow the unshrunk sleeve to shrink into position.

In particular, the carton is comprised of a pair of opposed sides having front and rear edges, a front wall connected between the front edges, a rear wall connected between the rear edges, a top panel connected to one of the walls, and a reinforcing flap connected to the other of the walls and being disposed beneath the top panel with the flap having a terminal portion thereof adapted to be sandwiched between a closure for a bottle adapted to be contained in the carton and with the top panel thereby holding the flap adjacent the top of the carton. The flap has a portion adjoining the terminal portion which has opposed supporting side edges disposed in spaced relation beneath the top panel enabling the flap to serve as a horizontal reinforcement against collapse of the sides upon squeezing the sides toward each other in grasping the carton; and, the flap may be disposed in position and the carton closed while allowing an unshrunk sleeve of the character mentioned to be placed around the lower portion of the closure and the top portion of the neck without sliding such sleeve out of position or damaging same thereby allowing more rapid packaging of a bottle in the carton.

Other details and advantages of the invention will become apparent as the following description of the embodiments thereof in the accompanying drawings proceeds.

BRIEF DESCRIPTION OF THE DRAWINGS

The accompanying drawings show present preferred embodiments of this invention, in which.

DESCRIPTION OF ILLUSTRATED EMBODIMENTS

Figure 1:
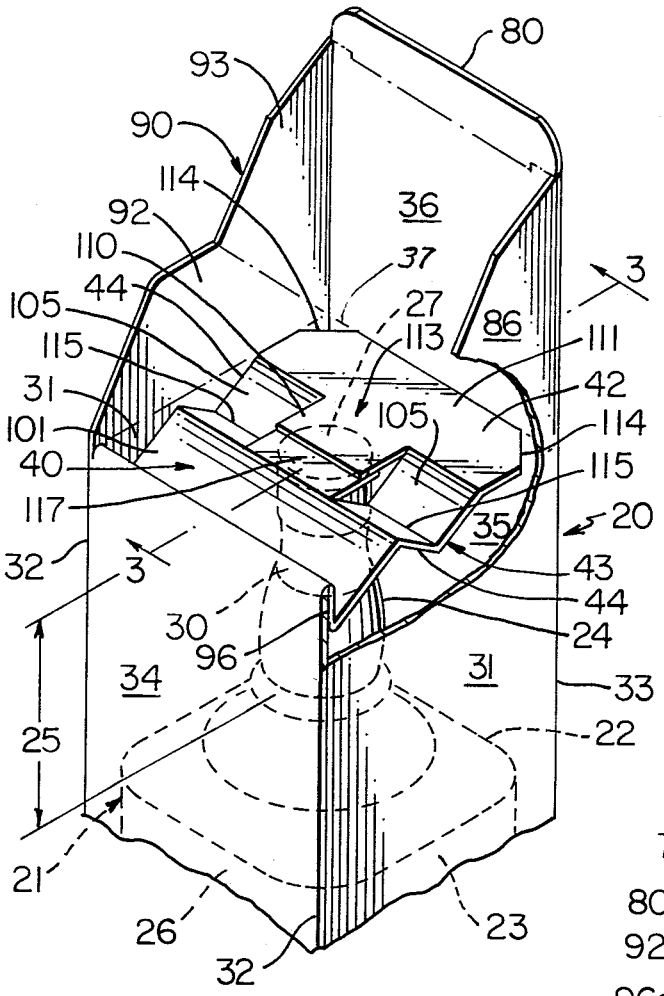
FIG. 1 is a fragmentary perspective view illustrating the upper portion of one exemplary embodiment of an open top carton of this invention which has a bottle contained therein with such bottle having a lower main body and an elongated neck provided with a closure and showing a sealing sleeve shrunk against the lower portion of the closure and the top portion of the neck to seal the closure on the bottle.
Figure 2:
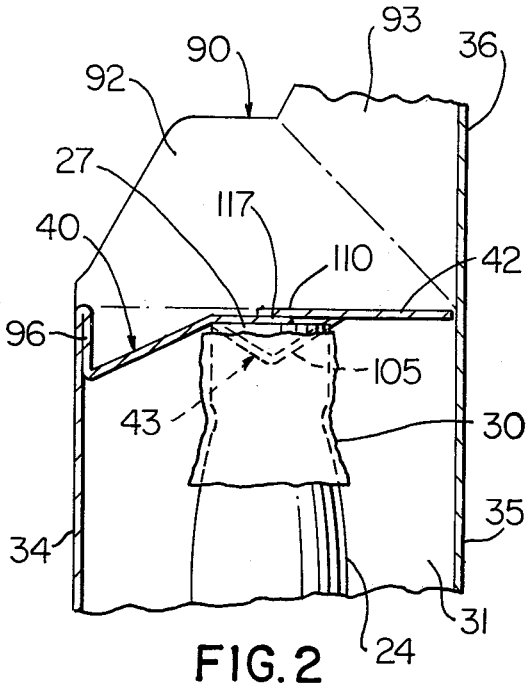
FIG. 2 is a fragmentary cross-sectional view of the upper portion of the carton of FIG. 1 with a top wall portion thereof open and with the bottle neck in elevation while illustrating the sleeve in its unshrunk condition.
Figure 3:
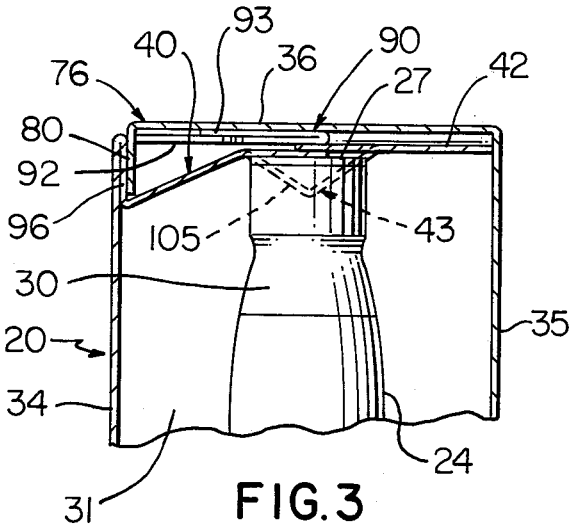
FIG. 3 is a fragmentary cross-sectional view taken essentially on the line 3—3 of FIG. 1 illustrating the upper portion of the carton with the top wall thereof closed and with the sleeve shrunk in position.

Reference is now made to FIGS. 1–3 of the drawings which illustrate an exemplary embodiment of the carton of this invention which is designated generally by the reference numeral 20 and such carton is preferably in the form of a decorative gift carton particularly adapted to contain an exemplary bottle which is designated generally by the reference numeral 21. The bottle 21 may be of any type and size and made of any suitable material including plastic, glass, or the like and is particularly adapted to contain a liquid product in the form of a beverage, for example. The bottle 21 of this example of the invention is in the form of a whiskey bottle of half-gallon size and has a main body 22 which corresponds roughly in peripheral outline to the corresponding outline of the body of the carton 20 and the body 21 has peripheral walls 23 disposed in closely spaced relation to the inside surface of the vertical walls of the carton 20 so as to insure the bottle will not move horizontally within its carton 20. The bottle 21 has an elongated neck 24 which converges from the main body and is substantially centrally disposed above such body 22 and the neck 24 extends as an elongated stem-like neck of substantial height 25 above the body 22. The bottle 21 is particularly adapted to contain a beverage such as whiskey 26, or the like, and has a top closure 27 which has a plastic sleeve 30 shrunk in position between the closure 27 and the neck 24 and the sleeve 30 serves as a seal between the closure 27 and neck 24.

The carton 20 comprises a pair of opposed sides each designated by the same reference numeral 31 and each side 31 has a front edge 32 and a rear edge 33; and, the carton 20 has a front wall 34 connected between the front edges 32 and a rear wall 35 foldably connected between the rear edges 33. The carton 20 also has a top panel 36 foldably connected to the rear wall 35 along a score line 37 and a reinforcing flap which is designated generally by the reference numeral 40 foldably connected to the front wall 34.

The reinforcing flap 40, in the closed carton 20, is disposed beneath the top panel 36 and such flap 40 has a terminal portion thereof which is designated generally by the reference numeral 42 sandwiched between the top closure 27 of the bottle 21 and the top panel 36 thereby holding the flap 40 adjacent the top of the carton 20. The reinforcing flap 40 has a portion which is designated generally by the reference numeral 43 adjoining the terminal portion 42 and such adjoining portion 43 has opposed supporting side edges each designated by the same general reference numeral 44 and the edges 44 are disposed in spaced relation beneath the top panel 36 enabling the reinforcing flap 40 to serve as a horizontal reinforcement against collapse of the sides 31 upon squeezing such sides toward each other in grasping the carton 20 for lifting and/or carrying purposes. It will be appreciated that with a carton 20 containing a half-gallon whiskey bottle 21 of the character mentioned it is common practice to grasp and carry such carton by placing a thumb against and along one of the sides 31 and the fingers against and along the other side 31 with the palm extending across the top panel and with such grasping and carrying the reinforcing flap 40 of this invention assures the side walls 31 remain substantially intact and free of any tendency to collapse, or the like.

In addition to the carton 20 being provided with a flap 40 having opposed supporting side edges 44 which engage the carton sides so that such flap prevents collapse of the carton sides 31 at the top thereof, the carton 20 has integral means which enable such carton (in the embodiment thereof illustrated in FIGS. 1–3) to have a sealing sleeve 30 for its bottle 21 disposed loosely around the bottle neck 24 and top closure 27 while enabling the top panel 36 thereof to be closed and the closed carton packed in a shipping and storage box prior to shrinkage of the sleeve 30 in position. It is possible to close the carton 20 without the reinforcing flap 40 engaging the sleeve 30 in the embodiment of the carton illustrated in FIGS. 1–3 whereby such sleeve cannot be damaged or slid downwardly along the neck 24 of the bottle; and, in the embodiments of the carton of this invention to be subsequently described the sleeve 30 is only engaged at either a couple of spaced points or essentially along a line contact whereby such sleeve is, in essence, restrained against vertical movement until shrinkage thereof.

Figure 10A:
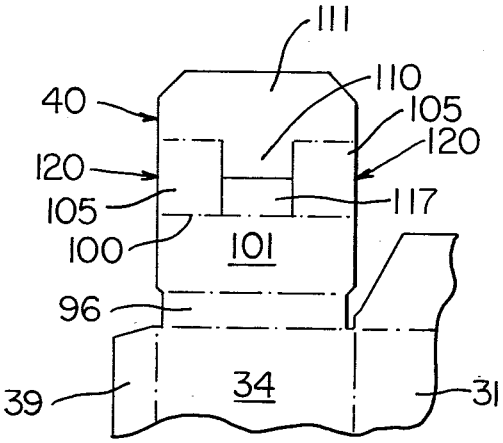
FIG. 10A is a fragmentary view of a blank identical to the blank of FIG. 10 except for the reinforcing flap portion thereof which basically is the only part shown and the blank of FIG. 10A is used to make the carton disclosed in FIGS. 4 through 9.
Figure 4:
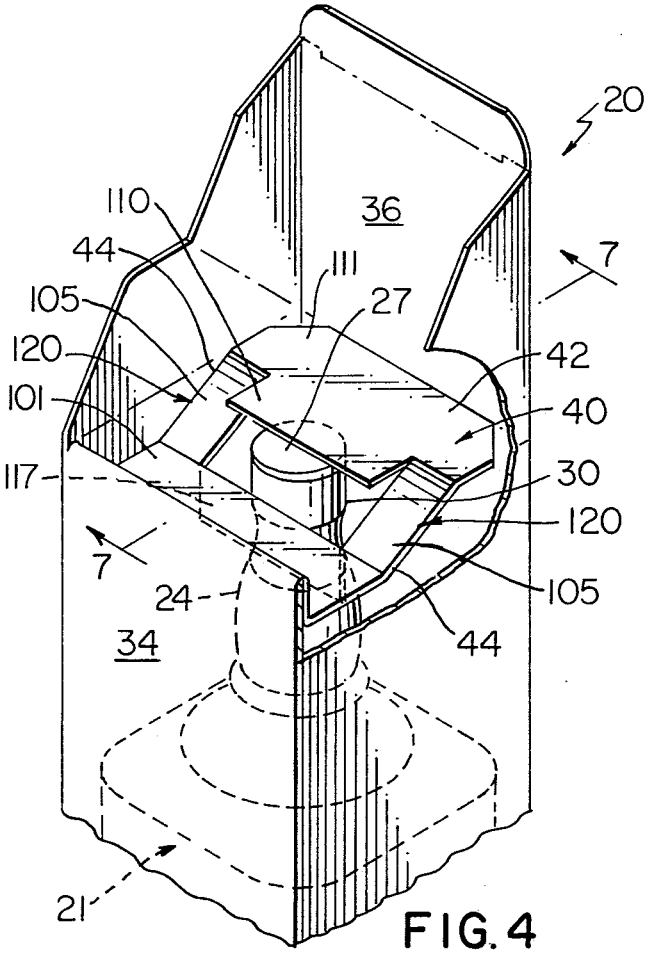
FIG. 4 is a view similar to FIG. 1 illustrating another exemplary embodiment of the carton of this invention having a modified reinforcing flap provided with a tab member disposed vertically downwardly.
Figure 5:
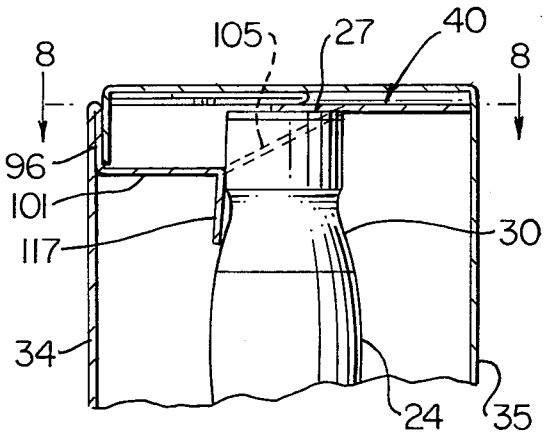
FIG. 5 is a view taken essentially on line 5—5 of FIG. 4 with the top wall of the carton closed.
Figure 10:
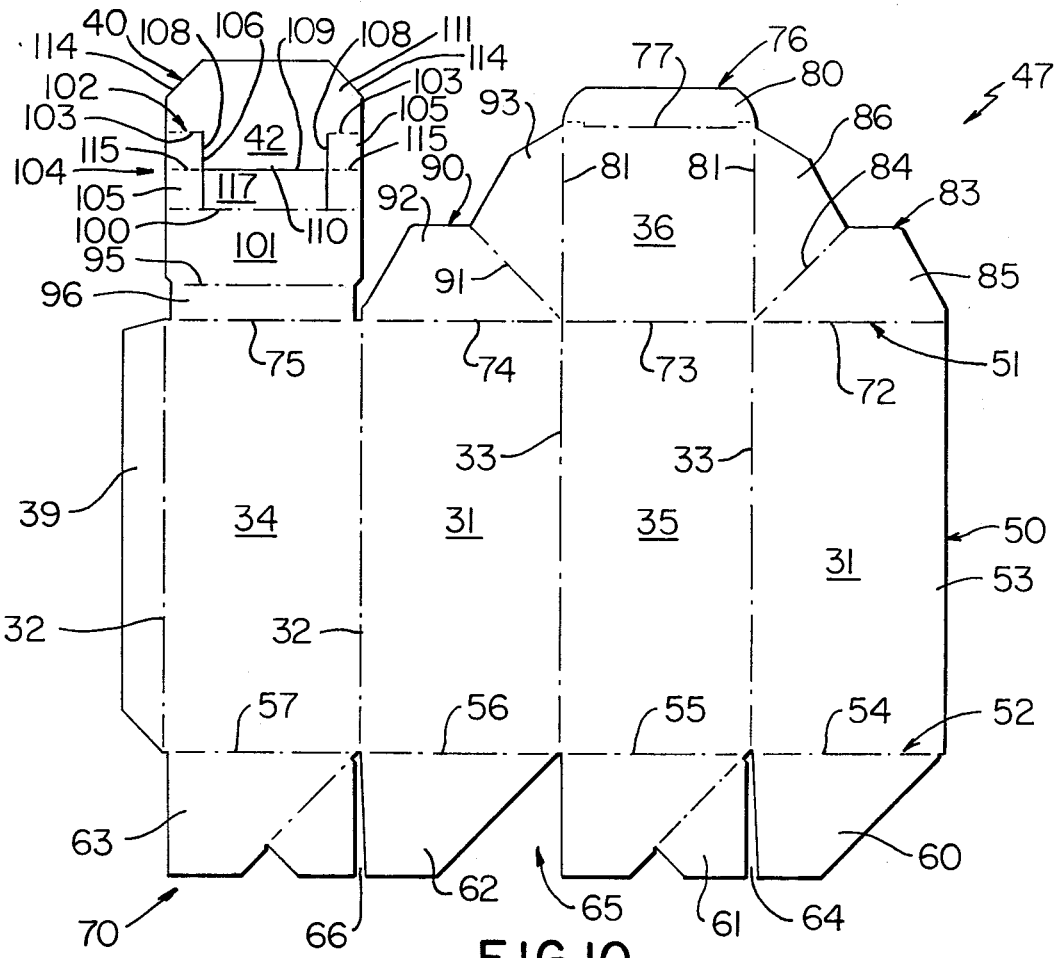
FIG. 10 is a plan view of a single piece blank which may be employed to make the carton of FIG. 1.
Figure 8:
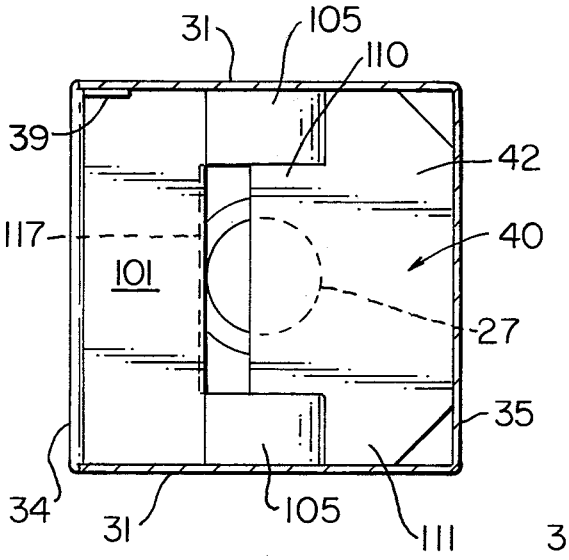
FIG. 8 is a view taken essentially on the line 8—8 of FIG. 5.

The carton 20 may be made in any suitable manner and from any suitable foldable material; however, such carton is preferably made from a carton blank which is designated generally by the reference numeral 47 and is illustrated in FIG. 10 of the drawings. The blank 47 may be made of paperboard, cardboard, or the like, and may have one or both surfaces thereof laminated with metallic foil such as aluminum-containing metallic foil, and suitably colored, embossed, imprinted, or remain plain, as desired.

The detailed description of the blank 47 will now proceed together with a further descriptipn of the carton and for ease of description, simplicity, and clarity parts of the blank will be designated in the drawings by the same reference numerals as corresponding parts of the assembled carton 20.

The blank 47 has a central portion 50 of substantially rectangular outline which is defined by a pair of spaced apart parallel continuous score means designated generally by the reference numerals 51 and 52 at the top and bottom thereof respectively; and, the central portion 50 has a plurality of four spaced apart parallel score lines disposed perpendicular to the score means 51 and 52 of the four score lines two at one end of portion 50 are designated by the same reference numeral 32 and two at the other end of portion 50 are designated by the reference numeral 33. The score lines 32 define the front wall 34 therebetween with a glue flap 39 outwardly of one score line 32. The score lines 33 define rear wall 35 therebetween and in the assembled carton the glue flap 39 is adhesively fixed to an outer portion 53 of a side 31. Accordingly, it will be seen that the score lines 32 define the front edges 32 of the sides 31 and the score lines 33 define the rear edges of such sides whereby the front wall 34 may be considered as being foldably connected between the front edges 32 of sides 31 and rear wall 35 may be considered as being foldably connected between the rear edges 33 of the sides 31.

The score means 52 is defined by a plurality of four end aligned (i.e., aligned in end-to-end relation) score line portions 54, 55, 56, and 57 defining bottom edges of one of the side walls 31, rear wall 35, the other side wall 31, and the front wall 34 respectively. The score lines 54, 55, 56, and 57 have extension flaps 60, 61, 62, and 63 respectively extending outwardly thereof and defined by suitable cutouts in the form of cutout 64 (an elongated cutout) between flaps 60 and 61, cutout 65 (a triangular cutout) between flaps 61 and 62, and cutout 66 (an elongated cutout) between flaps 62 and 63. The flaps 60, 61, 62, and 63 are adapted to be foldably connected in the assembled blank 47 to define a bottom wall, which is designated generally by the reference numeral 70 in FIG. 10, for the carton 20.

The score means 51 of the blank 47 is defined by a plurality of four end aligned score line portions 72, 73 74, and 75 defining the top edges of one of the side walls 31, rear wall 35, the other side wall 31, and the front wall 34 respectively. It will also be seen that the blank 47 has an uncut structure or extension 76 of roughly trapezoidal outline adjoining the score lines 72, 73, and 74 and such structure defines a top wall or top wall structure also designated 76 for the carton 20. The blank 47 has the top panel 36 which define the center part of structure 76 and is foldably connected thereto along the score line 73 and such top panel 36 has a score line 77 defining the terminal outer edge thereof with a tuck flap 80 extending outwardly of score line 77. The roughly trapezoidal structure 76 also has a pair of parallel score lines each designated by the same reference numeral 81 which extend between the score lines 73 and 77 and each score line 81 is disposed immediately above an associated score line 33 and is aligned therewith.

The side 31 defining an outer portion of the blank 47 has a flap 83 foldably connected to its score line portion 72 and flap 83 is foldably connected to the top panel 36 along an associated score line 81; and, in this example a diagonal score line 84, disposed at an angle of roughly 45° with the score line 72, is provided in flap 83 and divides flap 83 into two flap portions 85 and 86. The other side 31 has a flap 90 foldably connected to its score line portion 74 and the flap 90 is foldably connected to the top panel 36 along an associated score line 81 and also has a diagonal score line 91 which is disposed at an angle of roughly 45° to the score line 74 whereby score line 91 defines a pair of flap portions 92 and 93. Once the top panel 36 is moved in position to close the carton 20 assembled from blank 47, the panel 93 overlies its adjoining panel 92 while the panel 86 overlies its adjoining panel 85 whereby the trapezoidal structure 76, in essence, defines the top wall of the carton 20 and such top wall will also be designated by the general reference numeral 76, see FIG. 3.

The blank 47 has the carton reinforcing flap 40 foldably connected to the front wall 34 along the score line portion 75 of the score means 51; and, as seen in FIG. 10 the flap 40 has a second score line 95 arranged in parallel spaced relation to the score line 75 defining a first strip 96 therebetween. The flap 40 has a third score line 100 disposed in spaced relation from and parallel to the second score line 95 defining a second strip 101 therebetween; and, flap 40 has score means designated generally by the reference numeral 102 and comprised of a pair of spaced apart score lines arranged on a common rectilinear line and each designated by the same reference numeral 103 and disposed on opposite sides of the flap 40. The score means 102 and score line 100 define strip means therebetween designated generally by the reference numeral 104 and the strip means 104 comprises a pair of rectangular strips 105 each disposed between an associated end portion of the score line 100 and an associated score line 103.

The reinforcing flap 40 also has an H-shaped cut 106 between the score line 100 and score means 102; and, the H-shaped cut 106 is defined by a pair of spaced parallel legs 108 disposed perpendicular to the score line 100 and a transverse arm 109 disposed parallel to score line 100 between the legs 108 with the arm 109 having terminal ends adjoining the legs 108.

The terminal outer portion 42 of the flap 40 is of T-shaped configuration defined by a leg portion or leg 110 disposed perpendicular to the front wall 34 in the assembled carton and an adjoining crossarm portion or cross-arm 111 disposed parallel to such front wall 34. The leg portion 110 is disposed above the closure 27 of the bottle 21 and the crossarm portion 111 is also disposed above the closure 27 though spaced horizontally therefrom as indicated at 113 in FIG. 1. The T-shaped terminal outer portion 42 of the flap 40 has triangular cutouts as indicated at 114 at its outer corners which define the outer corners of the crossarm portion 111. It will also be seen that the strip means 104 comprised of the pair of strips 105 has a pair of score lines each designated by the same reference numeral 115 and each in a strip 105. As seen in FIG. 10, each score line 115 is disposed in aligned end-to-end relation with the transverse arm 109 of the H-shaped cut.

In the assembled carton 20 each of the score lines 115 defines the apex of an associated V-shaped rib-like structure or rib defined by a strip 105 and such rib is also designated 105 in FIG. 1. Each previously described supporting side edge 44 is defined by an outer edge of a V-shaped rib 105 and an adjoining edge of strip 101.

To facilitate folding of the flap 40 in position against wall 34, the strip 96 has a width which is narrower than the width of the front wall 34; and, the remainder of the reinforcing flap 40 has a width which is approximately equal (only slightly less) to the width of the front wall 34 and rear wall 35 throughout the major part of the extension of flap 40 from score line portion 75 which serves as a hinge line for the reinforcing flap 40 to the front wall 34.

As will be readily apparent from FIGS. 1 and 10 of the drawings, the score line 100 and the H-shaped cut 106 also define a tab member 117 and the tab member 117 is particularly adapted to be disposed against the top surface of the closure 27 with the leg portion 110 of the T-shaped outer portion 42 being disposed in overlapping relation thereagainst.

The blank 47 is assembled to define an open top carton by fastening glue flap 39 to outer portion 53 of side 31. The flaps 60–63 are then fastened to define bottom wall 70 whereupon top wall structure 76 extends vertically upwardly from rear wall 35 and flap 40 extends vertically upwardly from front wall 34. Once this is achieved, the bottle 21 with its closure 27 in position is disposed in the open top carton and unshrunk sleeve 30 placed around the closure 27 and neck 24. The reinforcing flap 40 is then folded in position, essentially in the manner illustrated in FIG. 1 of the drawings, so that the rectangular strip 96 is disposed flatly against the front wall 34 and tab member 117 is disposed against the closure 27. The strip 101 is thus disposed at an acute angle to the strip 96 and the parallel front wall 34. The strip means 104 are in the form of strips 105 now arranged as V-shaped strengthening ribs 105 disposed along opposite sides of the reinforcing flap 40. The leg portion 110 is then disposed above closure 27 and against tab member 117 whereupon the top structure 76, including top panel 36, is folded in position to define the top wall 76 of the carton 20. During the folding of top wall 76 the flap or wing panel portions 85 and 92 are disposed against the reinforcement flap 40 while the flap or wing panel portions 86 and 93 are disposed outwardly of and against portions 85 and 92 respectively. This folding action is made possible by the score lines 84 and 91 whereupon the top panel 36 is then folded in position so that the tuck flap 80 is disposed against the strip 96.

It will be appreciated that in the carton 20 of FIGS. 1–3 and as defined by the blank 47 of FIG. 10 no part of the reinforcing flap 40 comes into contact with the sleeve 30 whereby such sleeve may be placed in position around the neck 24 of its bottle essentially as illustrated in FIG. 2 and the carton 20 closed in a manner described above whereupon the packing of bottles 21 within cartons 20 may be achieved in a continuous uninterrupted process with the sleeves 30 shrinking in position essentially as shown in FIG. 3 after the bottles 21 have been packaged in their cartons and in due course, with the time for sleeve shrinkage being determined by the type of sleeve 30 and environmental conditions, as is known in the art. Accordingly, it is not necessary to delay the closing of each carton 20 until its associated bottle sealing sleeve 30 dries as is often the case with similar types of cartons proposed heretofore.

Modifications of the carton 20 are illustrated in FIGS. 4–8 and 9 and it will be seen that in each of these FIGS. 4–8 and 9, the carton and associated components thereof as well as the bottle and its associated components have been designated by the same reference numerals as previously in connection with the carton 20 and the bottle 21. The main difference between the carton FIGS. 4–8 and FIG. 9 and the carton 20 is in the reinforcement flap 40 which is minus score lines 115 as illustrated in each instance at 120 in each of FIGS. 4, 9, and 10A. The other portions of the carton of FIGS. 4–8 and 9 and the blank used to make same shown in FIG. 10A are identical.

Figure 7:
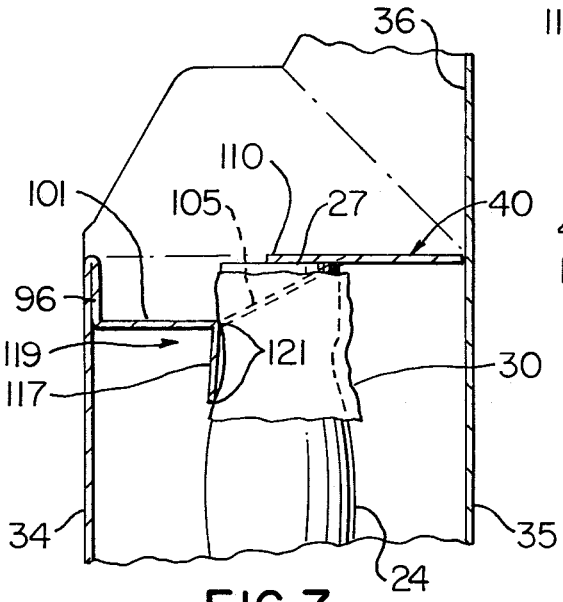
FIG. 7 is a fragmentary cross-sectional view similar to FIG. 2 illustrating the reinforcing flap disposed in position and with a tab member thereof contacting the unshrunk sleeve at only two points enabling the carton top wall to be placed in position.
Figure 6:
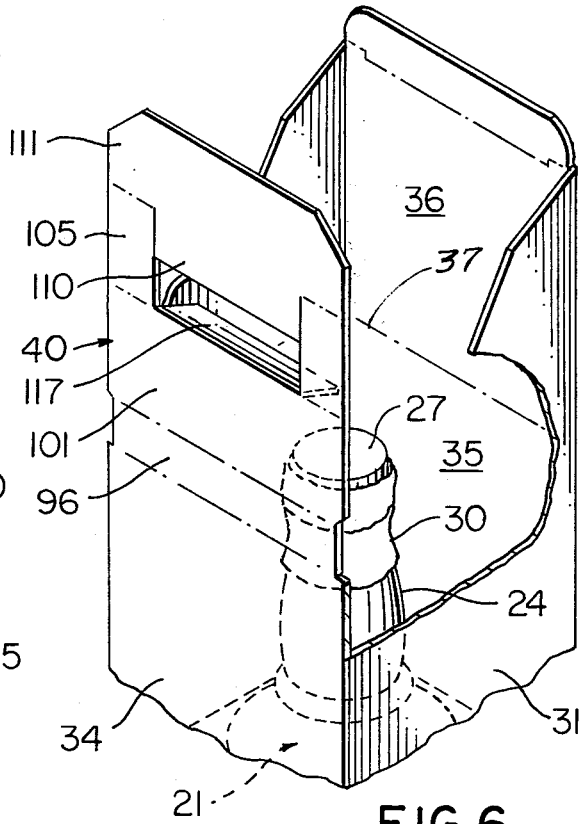
FIG. 6 is a fragmentary perspective view of the carton of FIG. 4 and shows a reinforcing flap thereof extending vertically upwardly from the front wall of the carton, a top wall portion thereof extending upwardly from the rear wall, and an unshrunk sleeve disposed around the closure and neck of the bottle.

With the carton of FIGS. 4–8, as modified to eliminate the score lines 115, it will be seen that the tab member 117 is folded about its score line 100 so it extends perpendicularly downwardly from its adjoining strip 96 and against the unshrunk sleeve 30, as shown at 119 in FIG. 7, so as to engage such unshrunk sleeve at a pair of spaced line contact points indicated at 121. The strip 101 in this example of the carton 20 is disposed horizontally whereby the strips 105 are disposed at an upwardly inclined angle to the horizontal strip 101. Accordingly, each supporting side edge 44 of the carton 20 of FIGS. 4–8 is defined by adjoining cooperating edges of strips 101 and 105 which may be considered as strip means arranged in a substantially L-shaped pattern.

Figure 9:
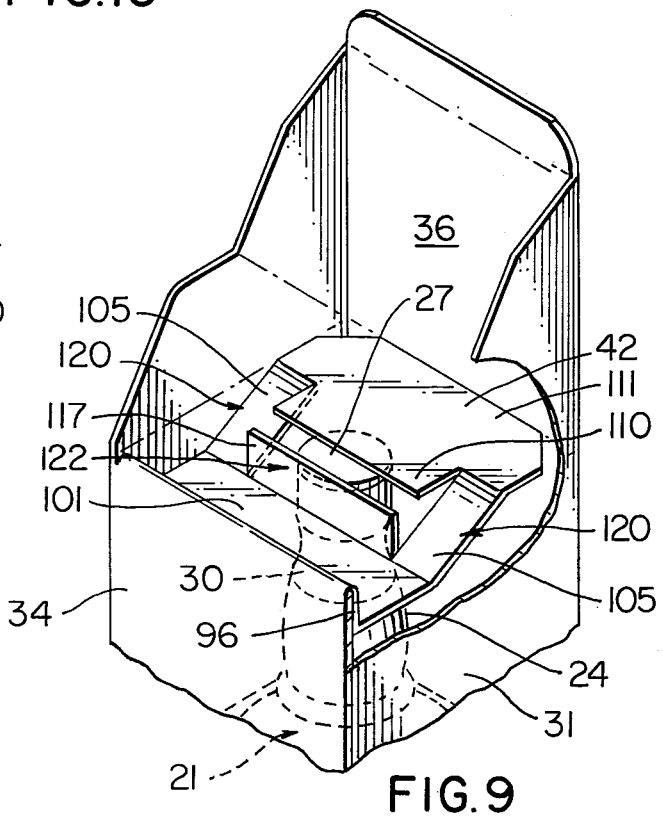
FIG. 9 is a view similar to FIG. 4 illustrating the reinforcing flap having its tab member disposed in a position different from the position shown in FIG. 7.

The carton of FIG. 9 is identical to the carton of FIGS. 4–8 and is made from the blank 47 shown in FIG. 10A.

The only difference is that the tab member 117 in the carton 20 of FIG. 9 extends perpendicularly upwardly from the strip 101 as shown at 122.

The blank 47 illustrated in FIG. 10 and the modified blank illustrated in FIG. 10A may each be assembled utilizing any technique known in the art and it will be appreciated that adhesive means are provided on glue flap 39 and the flaps 60–63 defining the bottom wall 70 in any manner known in the art to define the completed carton. It will be appreciated that any suitable adhesive means, or the like, may be provided for this purpose.

Terms such as top, bottom, inwardly, outwardly, bottom wall, side, front wall, rear wall, top panel, top wall, and the like, have been utilized in this disclosure and the appended claims merely to define the positions of various components of the carton essentially as shown in the drawings; however, it is to be understood that the carton and blank of this invention may be oriented in any desired manner.

While present embodiments of this invention, and methods of practicing the same, have been illustrated and described, it will be recognized that this invention may be otherwise variously embodied and practiced within the scope of the following claims.

What is claimed is:

1. A carton for a bottle having a body and an elongated upwardly extending neck provided with a closure, said carton comprising: a pair of opposed sides having front and rear edges; a front wall connected between said front edges; a rear wall connected between said rear edges; a top panel connected to one of said side walls; and a reinforcing flap connected to the other of said walls and being disposed beneath said top panel, said flap being foldably connected to said other wall along a first score line and comprising a second score line arranged in parallel spaced relation to said first score line defining a first strip therebetween, a third score line disposed in parallel spaced relation to said second score line defining a second strip therebetween, score means disposed parallel to the third score line defining strip means therebetween, and an H-shaped cut between said third score line and score means, said H-shaped cut and score means defining a roughly T-shaped terminal outer portion of said flap, said outer portion being defined by a leg disposed perpendicular to said other wall and a cross arm adjoining and disposed parallel to said leg, said leg being sandwiched between said closure and top panel and thereby holding said flap adjacent the top of said carton, said second strip and said strip means defining a portion of said flap which adjoins said terminal portion and has opposed supporting side edges disposed in spaced relation beneath said top panel enabling said flap to serve as a horizontal reinforcement against collapse of said sides upon squeezing said sides toward each other in grasping said carton.

2. A carton as set forth in claim 1 in which said first strip is disposed against said other wall and said second strip is disposed transverse said first strip.

3. A carton as set forth in claim 2 in which said second strip is disposed so as to define an acute angle between said first and second strips.

4. A carton as set forth in claim 2 in which said second strip is disposed at an angle of 90° to said first strip.

5. A carton as set forth in claim 4 in which said third score line and said H-shaped cut define a tab member which is supported by said neck substantially perpendicular to said third score line.

6. A carton as set forth in claim 5 in which said tab member extends perpendicularly upwardly from said third score line.

7. A carton as set forth in claim 5 in which said tab member extends perpendicularly downwardly from said third score line.

8. A carton as set forth in claim 1 in which said sides have extensions which are foldably connected thereto and to said top panel and cooperate to define a top wall for said carton, said extensions being bifolded with said top panel folded thereagainst to define a top wall for said carton.

9. A carton as set forth in claim 8 in which said top panel has a tuck flap foldably connected thereto and adapted to be inserted against said first strip sandwiching said first strip between said other wall and said tuck flap.

10. A carton as set forth in claim 1 in which said first strip has a width which is narrower than the width of said other wall, said other wall is said front wall, and the remainder of said reinforcing flap has a width that is substantially equal to said front wall throughout the major part of its extension from said front wall.

11. A carton as set forth in claim 1 in which said first strip is disposed against said other wall, said second strip is disposed substantially horizontally, and said strip means is defined by a pair of rectangular strips adjoining opposite end portions of said third score line, each rectangular strip extending upwardly from said third score line to an associated portion of said score means, said second strip and said strip means defining said opposed supporting side edges each of which is arranged in a substantially L-shaped configuration.

12. A carton as set forth in claim 1 in which said H-shaped cut is defined by a pair of spaced parallel legs disposed perpendicular to said third score line and having a transverse arm disposed between said legs parallel to said third score line.

13. A carton as set forth in claim 12 in which said strip means is defined by a pair of strips on opposite sides of said parallel legs of said H-shaped cut and further comprising a pair of score lines disposed in aligned relation in said strip means as continuations at opposite ends of said transverse arm of said H-shaped cut with each of said pair of score lines defining an associated apex of an associated one of said pair of strips disposed in a V-shaped pattern, said opposed supporting side edges being defined by opposed edges of said second strip and outer edges of said strips disposed in a V-shaped pattern, each of said strips disposed in a V-shaped pattern serving as a V-shaped reinforcing rib.

14. A carton for a bottle having a body and an elongated upwardly extending neck provided with a closure and having an initially unshrunk shrinkable plastic sleeve disposed against said closure and neck with said sleeve being subsequently shrunk in position; said carton comprising; a pair of opposed sides having front and rear edges; a front wall connected between said front edges; a rear wall connected between said rear edges; a top panel connected to one of said walls; and a reinforcing flap connected to the other of said walls and being disposed beneath said top panel; said flap having a terminal portion thereof sandwiched between said closure and top panel thereby holding said flap adjacent the top of said carton; said flap having a portion adjoining said terminal portion which has opposed supporting side edges disposed in spaced relation beneath said top panel enabling said flap to serve as a horizontal reinforcement against collapse of said sides upon squeezing said sides toward each other in grasping said carton; said terminal outer portion having a roughly T-shaped configuration defined by a leg disposed perpendicular to said other wall and an adjoining crossarm disposed parallel thereto; said leg being disposed above said closure; said flap being foldably connected to said other wall along a first score line and further comprising, a second score line arranged in parallel spaced relation to said first score line defining a first strip therebetween, a third score line disposed in parallel spaced relation to said second score line defining a second strip therebetween, score means disposed parallel to said third score line defining strip means therebetween, and an H-shaped cut between said third score line and score means, said H-shaped cut and score means defining said T-shaped outer portion with said second strip and said strip means having edges defining said opposed supporting edges, said third score line and said H-shaped cut defining a tab member which is supported by said neck.

15. A carton as set forth in claim 14 in which said tab member engages and is supported by said closure and said leg of said T-shaped outer portion engages and is supported by said tab member such that said unshrunk sleeve is essentially isolated and allowed to shrink in an unobstructed manner with said top panel closed.

16. A carton as set forth in claim 14 in which said leg of said T-shaped outer portion engages and is supported by said closure.

17. A carton as set forth in claim 16 in which said tab member extends vertically upwardly from said third score line and engages said unshrunk sleeve holding said unshrunk sleeve lightly against said closure with said unshrunk sleeve making essentially a line contact with said closure thereby enabling said unshrunk sleeve to shrink in a substantially unobstructed manner with said top panel closed.

18. A carton as set forth in claim 16 in which said tab member extends vertically downwardly from said third score line and engages said unshrunk sleeve holding said unshrunk sleeve lightly against said closure and neck with said unshrunk sleeve making essentially a line contact with said closure and neck thereby enabling said unshrunk sleeve to shrink in a substantially unobstructed manner with said top panel closed.

19. A blank being suitably cut and scored to define a carton for a bottle upon assembly thereof with said bottle having a body and an elongated upwardly extending neck provided with a closure and having an initially unshrunk shrinkable plastic sleeve disposed against said closure and neck with said sleeve being subsequently shrunk in position; said blank comprising; a pair of opposed sides having edges defining front and rear edges in said resulting carton; a front wall connected between said front edges in said resulting carton; a rear wall connected between said rear edges in said resulting carton; a top panel connected to one of said walls; and a reinforcing flap connected to the other of said walls and being disposed beneath said top panel in said resulting carton; said flap having a terminal portion thereof sandwiched between said closure and top panel thereby holding said flap adjacent the top of said resulting carton; said flap having a portion adjoining said terminal portion which has opposed supporting side edges disposed in spaced relation beneath said top panel in said resulting carton enabling said flap to serve as a horizontal reinforcement against collapse of said sides upon squeezing said sides toward each other in grasping said resulting carton; said terminal outer portion having a roughly T-shaped configuration defined by a leg disposed perpendicular to said other wall of said resulting carton and an adjoining cross-arm disposed parallel thereto; said leg being disposed above said closure in said resulting carton; said flap being foldably connected to said other wall along a first score line and further comprising, a second score line arranged in parallel spaced relation to said first score line defining a first strip therebetween, a third score line disposed in parallel spaced relation to said second score line defining a second strip therebetween, score means disposed parallel to said third score line defining strip means therebetween, and an H-shaped cut between said third score line and score means, said H-shaped cut and score means defining said T-shaped outer portion with said second strip and said strip means having edges defining said opposed supporting edges in said resulting carton, said third score line and said H-shaped cut defining a tab member which is adapted to be supported by said neck of said bottle in said resulting carton.

20. A blank as set forth in claim 19 in which said sides have extensions which are foldably connected thereto and to said top panel and cooperate to define a top wall for said resulting carton, said extensions being bifolded with said top panel folded thereagainst to define said top wall for said resulting carton.

21. A blank as set forth in claim 20 in which said top panel has a tuck flap foldably connected thereto and adapted to be inserted against said first strip sandwiching said first strip between said other wall and said tuck flap in said resulting carton.

22. A blank as set forth in claim 21 in which said first strip has a width which is narrower than the width of said other wall, said other wall is said front wall of said resulting carton, and the remainder of said reinforcing flap has a width that is substantially equal to said front wall of said resulting carton throughout the major part of its extension from said front wall.

23. A blank as set forth in claim 20 in which said first strip is disposed against said other wall in said resulting carton, said second strip is disposed substantially horizontally in said resulting carton, and said strip means is defined by a pair of rectangular strips adjoining opposite end portions of said third score line, each rectangular strip extending upwardly from said third score line to an associated portion of said score means in said resulting carton, said second strip and said strip means defining said opposed supporting side edges in said resulting carton each of which is arranged in a substantially L-shaped configuration.

24. A blank as set forth in claim 20 in which said H-shaped cut is defined by a pair of spaced parallel legs disposed perpendicular to said third score line and having a transverse arm disposed between said legs parallel to said third score line.

25. A blank as set forth in claim 24 in which said strip means is defined by a pair of strips on opposite sides of said parallel legs of said H-shaped cut and further comprising a pair of score lines disposed in aligned relation in said strip means as continuations at opposite ends of said transverse arm of said H-shaped cut with each of said pair of score lines defining an associated apex of an associated one of said pair of strips which is disposed in a V-shaped pattern in said resulting carton, said opposed supporting side edges being defined by opposed edges of said second strip and outer edges of said strips each of which is disposed in a V-shaped pattern in said resulting carton, each of said strips disposed in said V-shaped pattern in said resulting carton serving as a V-shaped reinforcing rib.

* * * * *